US005487684A

United States Patent [19]

Schalk et al.

[11] Patent Number: 5,487,684

[45] Date of Patent: Jan. 30, 1996

[54] ELECTRICAL CONTACT PIN FOR PRINTED CIRCUIT BOARD

[75] Inventors: Petrus W. H. Schalk, Drunen; Paulus J. M. Pigmans, Tilburg, both of Netherlands

[73] Assignee: Berg Technology, Inc., Reno, Nev.

[21] Appl. No.: 357,058

[22] Filed: Dec. 14, 1994

Related U.S. Application Data

[63] Continuation of Ser. No. 192,769, Feb. 7, 1994, abandoned, which is a continuation of Ser. No. 954,127, Jul. 1, 1992, abandoned.

[51] Int. Cl.[6] ..... H01R 13/42

[52] U.S. Cl. ..... 439/715; 439/82; 439/84

[58] Field of Search ..... 439/751, 873, 439/83, 84, 82

[56] References Cited

U.S. PATENT DOCUMENTS

| | | | |
|---|---|---|---|
| 3,317,888 | 5/1967 | Mancini . | |
| 3,404,367 | 10/1968 | Henschen . | |
| 3,757,277 | 9/1973 | Yamanoue et al. . | |
| 3,865,462 | 2/1975 | Cobaugh et al. . | |
| 4,071,140 | 10/1987 | Orbanic | 439/751 |
| 4,306,761 | 12/1981 | Ress . | |
| 4,469,394 | 9/1984 | Verhoeven | 439/875 |
| 4,728,164 | 3/1988 | Lemmens et al. | 439/870 |
| 4,769,907 | 9/1988 | Sebastien | 29/874 |
| 4,790,773 | 12/1988 | Hahn . | |
| 4,867,710 | 9/1989 | Harting et al. | 439/757 |
| 4,878,861 | 11/1989 | Kendall et al. | 439/751 |
| 4,936,797 | 6/1990 | Wehrle et al. | 439/82 |
| 4,975,086 | 12/1990 | Reichardt et al. . | |
| 5,186,664 | 2/1993 | Abe . | |
| 5,259,793 | 11/1993 | Yamada et al. . | |

OTHER PUBLICATIONS

Dupont Compliant Press Fit Pins—Data Sheet, Dupont Corporation, Jun. 1985.

*Primary Examiner*—David P. Bryant

*Attorney, Agent, or Firm*—Woodcock Washburn Kurtz Mackiewicz & Norris

[57] ABSTRACT

An electrical contact pin is disclosed for mounting in a through hole in a printed circuit board. The contact pin has a pointed part and a longitudinal contact part which interacts with the hole when mounted therein. The cross-section of the contact part is generally H-shaped formed of four fins which project parallel to the longitudinal axis of the pin and are connected over the longitudinal distance of the contact part by a central cross rib and define two longitudinal recesses situated on either side of the cross rib. Each longitudinal recess has an essentially V-shaped floor. The contact part is made slightly curved at its short sides, each of which comprises two fins merging into each other over the entire longitudinal distance. The fins are also curved more inwardly by their fin ends starting from the pointed part over an appreciable part of the longitudinal distance. The curvature of the fin ends first gradually increasing starting at the pointed part, and then decreasing. A process for making such a contact pin is also disclosed in which the longitudinal recesses of the contact part with the V-shaped floors are formed at both sides of the cross rib by means of two corresponding knife-shaped dies. The contact part is enclosed by two opposite semi-cylindrical pressure elements over the longitudinal distance and is curved at the short sides by pressure. The above-mentioned appreciable part can be curved more greatly here, due to the fact that the two cylindrical pressure elements in the appreciable part have a semi-cylindrical piece with a smaller diameter and a semi-conical piece merging into a remaining semi-cylindrical piece with greater diameter.

3 Claims, 3 Drawing Sheets

ELECTRICAL CONTACT PIN FOR PRINTED CIRCUIT BOARD

This is a continuation, of application Ser. No. 08/192,769, filed Feb. 7, 1994, now abandoned; which in turn is a continuation of application Ser. No. 07/954,127, filed on Jul. 1, 1992, now abandoned.

BACKGROUND OF THE INVENTION

The invention relates to an electrical contact pin for mounting in a through hole in a printed circuit board, which contact pin has a pointed part and a longitudinal contact part which interacts with the hole when mounted therein, and the cross-section of which in general has an H-shape formed through four fins which project parallel to the longitudinal axis of the pin and are connected over the longitudinal distance of the contact part by a central cross rib and define two longitudinal recesses situated on either side of the cross rib, each longitudinal recess having an essentially V-shaped floor. U.S. Pat. No. 4,728,164, granted Mar. 1, 1988 and assigned to applicants' assignee discloses such a contact. Such pins, also known as press-fit pins, are mounted in through holes of printed circuit boards. The holes are provided with a metallization, generally consisting of copper, possibly with a thin layer of tin over it. In such an electrical connection between pin and metallization no solder or similar bonding is required any more, but the electrical contact is obtained by the close form-fit and frictional connection.

In practice, such pins are virtually entirely made of square wire or flat strip material, the longitudinal recesses of the contact part being formed by stamping technology, and the fins being forced or extruded outwards, upwards or downwards. In the case of the pin known from the above-mentioned U.S. Patent the object is that the four fins on insertion of the pin into the hole of the printed circuit board should be bent inwards gradually, so that a four-point fixing in the hole is obtained. The H-shaped design means that the risk of the pin turning during mounting is reduced or ruled out. Consequently, as stated above, square pins of the type widely used in the printed circuit board industry can be used. It is very important here that the projecting fins are constructed absolutely symmetrical and have the same thickness, so that when they are being inserted in the hole all four bend over uniformly and engage the metallization in the hole. For, slight differences in thickness and therefore in stiffness of the projecting fins lead to rotation or excentric positioning of the pin being obtained during insertion, and this can cause serious damage to the metallization in the hole. It can also give rise to more wear in the counter plug present on the rear side of the printed circuit board, through the fact that the rotated square pin then has sharper engaging faces with the fixed counter plug.

In the case of the pin known from the above-mentioned U.S. Patent the flat floors have a V-shape on either side of the cross rib in the longitudinal recesses. The longitudinal recesses with the V-shaped floors are obtained by means of corresponding knife-shaped dies. During this stamping of the longitudinal recess this V-shaped floor acts as a centering facility, so that an absolutely symmetrical design of the fins on either side of the recess with the same thickness and height is obtained.

It has now been found in practice in the case of contact pins, and in particular when their dimensions are very small, that the deformations caused to the hole metallization still exceed those set in the standards. The deformation in the hole metallization is then e.g. greater than the requirement of 0.05 mm of the MIL standard. The transition present in the fin height in the known contact pin from the right pointed part to the contact part, which transition is curved inward slightly, has been found completely inadequate in practice to prevent such deformations.

SUMMARY OF THE INVENTION

The object of the invention is to solve this problem. This is achieved according to the invention with an electrical contact pin of the type mentioned in the preamble in that the contact part is made slightly curved at its short sides, each of which has two fins merging into each other over the entire longitudinal distance. In a preferred embodiment the fins are in this case made with their fin ends more strongly curved inwards from the pointed part over an appreciable part of the above-mentioned longitudinal distance. In a further embodiment of the invention the appreciable part comprises approximately half the above-mentioned longitudinal distance. In yet another embodiment of the invention this bending runs inwards, gradually first increasing from the pointed part, and then decreasing.

In the known process for manufacturing an electrical contact pin, as stated above, the longitudinal recesses of the contact part with the V-shaped floors are formed on both sides of the cross rib by means of two corresponding knife-shaped dies. According to the invention, the contact pin is now deformed over the longitudinal distance of the contact part, and in particular over the said appreciable part thereof by a press-on operation using two opposite press-on elements.

BRIEF DESCRIPTION OF THE DRAWINGS

The invention will be explained in greater detail with reference to an example of an embodiment shown in the drawings, in which.

DETAILED DESCRIPTION OF THE EMBODIMENTS

Figure 1A:
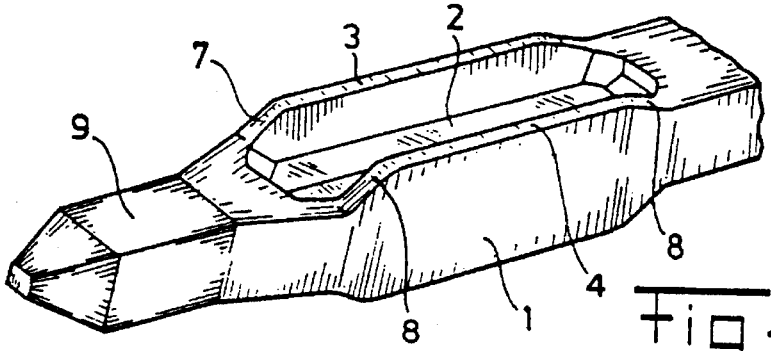
FIG. 1*a* gives a perspective view of the contact part after a first step of the manufacture of a contact pin according to the invention.
Figure 1B:
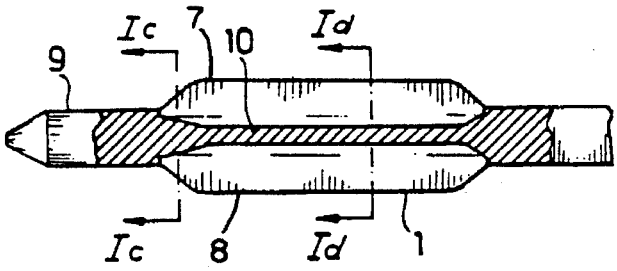
FIG. 1*b* gives a longitudinal sectional view of the contact part of the contact pin of FIG. 1*a;*
Figure 1C:
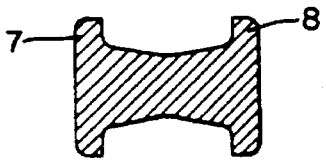
FIGS. 1*c* and 1*d* give a cross-sectional view of the contact part of FIG. 1*a* along the lines Ic—Ic and Id—Id respectively in FIG. 1*b;*
Figure 1D:
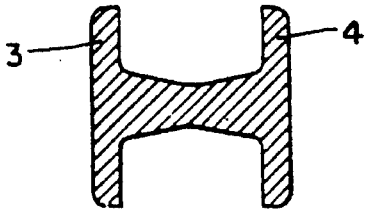

In FIG. 1*a* the contact part is indicated in its entirety by 1, the pointed part by 9, the longitudinal recess at one side of the contact part 2, the two fins on either side of the longitudinal recess formed by fins or fin-like contacts 3 and 4 and the gradually increasing and decreasing transition of these fins at the insertion and opposite side of the contact pin during a phase of manufacture by guiding portions 7 and 8 respectively. FIG. 1*b* shows a longitudinal section of the contact pin of FIG 1*a*, from which it can be seen clearly that the transverse or cross rib has the same thickness over a large part of the longitudinal distance of the longitudinal recess, but that the thickness increases slightly at the insertion side and at the opposite side corresponding to the transitions of the guiding portions 7 and 8, as is also indicated in the cross-sectional views of FIGS. 1*c* and 1*d*.

Figure 2A:
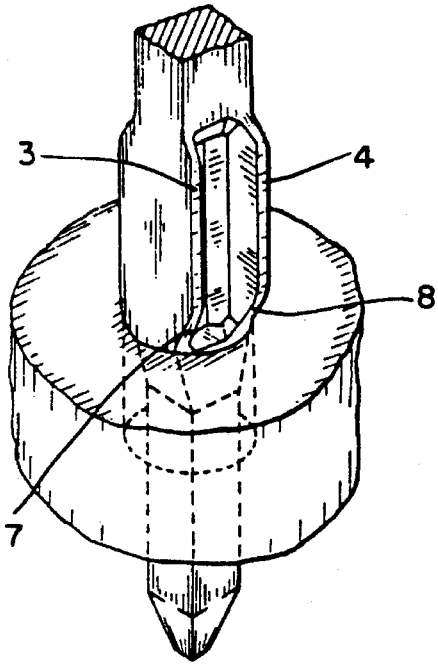
FIG. 2*a* gives a perspective view of the contact pin of FIG. 1*a* inserted into a printed circuit board hole.
Figure 2B:
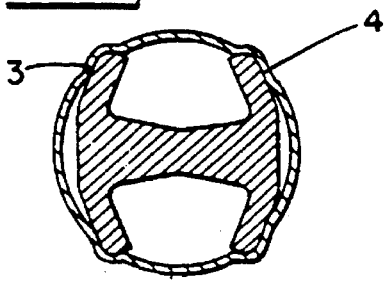
FIG. 2*b* gives a cross-sectional view of the contact pin inserted according to FIG. 2*a,* along the line Id—Id of FIG. 1*b;*

FIG. 2*a* shows a perspective view of an electrical contact pin according to FIG. 1*a* partially inserted into a printed circuit board hole. It can be seen clearly from this that there is initially only a small contact surface between the pin and the hole. FIG. 2*b* gives a cross-sectional view of the further inserted contact pin along the line Id—Id of FIG. 1*b*, from which it can be seen how the fins 3, 4 are bent inwards slightly in a uniform and symmetrical manner and make contact with the metallization of the hole. The H-shape of the contact part is approximately retained. It will be clear that this slight bending caused by the insertion during mounting does not yet occur at the gradual transitions of the guiding portions 7 and 8.

In the case of the known electrical contact pins generally used for one mm holes a press-in force of maximum 200 Newton and a press-out force (after temperature change tests) of minimum 35 Newton are required. In the case of contact pins for holes of 0.7 mm, according to the latest specifications, these values must be maximum 100 Newton for the press-in force and minimum 30 Newton for the press-out force.

As already mentioned, it has now been found that the deformation caused in the metallization, in particular in the case of contact pins of small dimensions, is greater than the 0.05 mm required according to the MIL standard. In order to deal with this problem, the contact pin according to the invention is deformed over an appreciable part of the longitudinal distance of the contact part, so that the fins ape curved inwards by their ends.

Figure 3A:
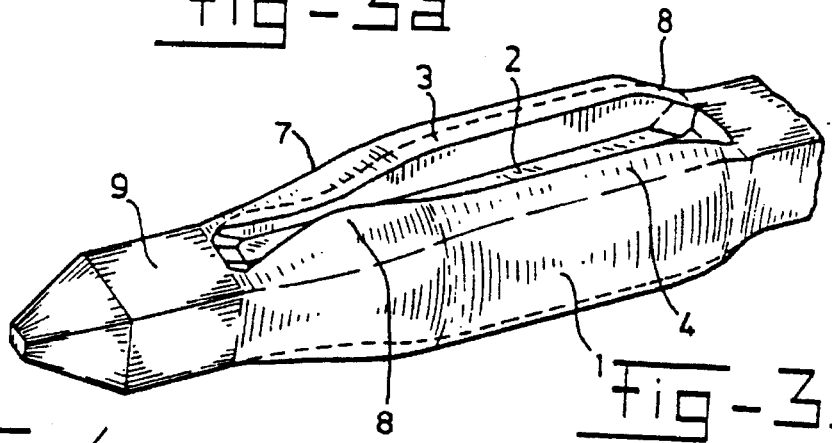
FIG. 3*a* gives a perspective view of the contact part of a finished contact pin according to the invention.
Figure 3B:
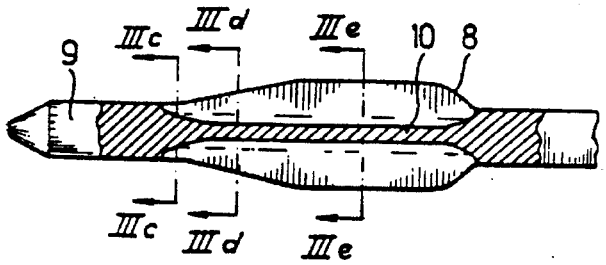
FIG. 3*b* gives a longitudinal sectional view of the contact part of the contact pin of FIG. 3*a;*
Figure 3C:
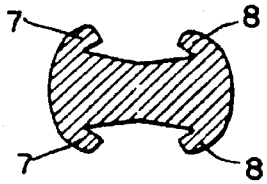
FIGS. 3*c,* 3*d* and 3*e* give respective cross-sectional views of the contact part of FIG. 3*a* along the lines IIIc—IIIc, IIId—IIId and IIIe—IIIe in FIG. 3*b;*
Figure 3D:
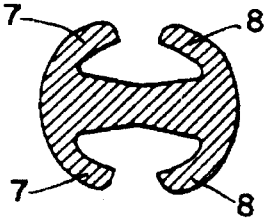
Figure 3E:
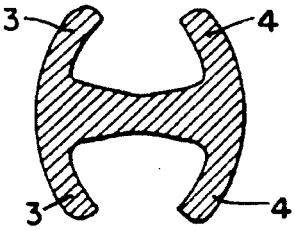

This embodiment is shown in perspective view in FIG. 3*a*. FIG. 3*b* shows a longitudinal section running along the longitudinal axis. FIGS. 3*c*, 3*d* and 3*e* show cross-sectional views of the contact pin of FIG. 3*a* along the lines IIIc—IIIc, IIId—IIId and IIIe—IIIe of FIG. 3*b* respectively. It can be seen from this that the fins 3, 4 are bent inwards over an appreciable part of the longitudinal distance of the contact part, gradually first increasing, and then decreasing. At the same time the height of the fins 3, 4 increases from the beginning to a maximum value, accompanied by a decrease in the thickness of the cross rib, as can be seen from a comparison of FIGS. 3*c*, 3*d* and 3*e*. The above-mentioned appreciable part can be approximately half the longitudinal distance. A more flexible insertion of the contact pin into the printed circuit board hole is obtained through this inward-bent state of the fins, which is strongest particularly in the part between the cross-sections IIIc—IIIc and IIId—IIId. The strict requirements of e.g. the MIL standard can be met by this design.

Figure 4A:
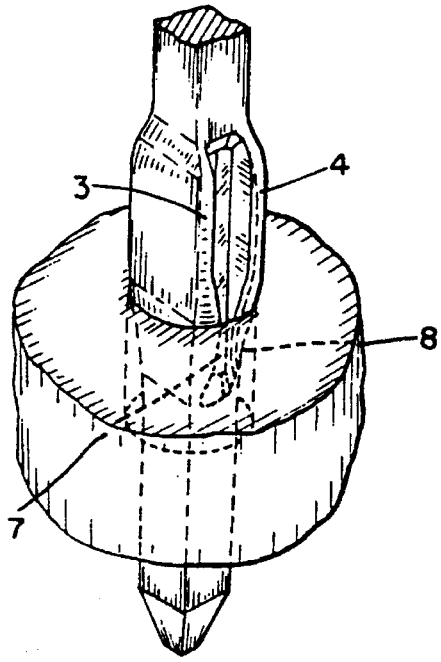
FIG. 4*a* gives a perspective view of the contact pin according to the invention inserted into a printed circuit board hole.
Figure 4B:
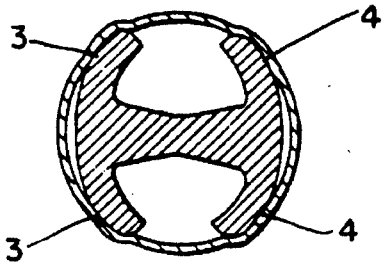
FIG. 4*b* gives a cross-sectional view of the contact pin inserted according to FIG. 4*a* along the line IIIe—IIIe of FIG. 3*b.

FIG. 4*a* again shows a perspective view of a contact pin according to the invention inserted partially into a printed circuit board hole. It can be seen here that, unlike the contact pin of FIG. 2*a*, there is initially a great contact surface between pin and metallization. FIG. 4*b* shows a cross-sectional view of the further inserted contact pin along the line IIIe—IIIe in FIG. 3*b*. The enlarged contact engaging faces between the fins 3, 4 and the metallization of the hole can also be seen from the latter cross-sectional view.

In the manufacture of these pins the longitudinal recesses of the contact parts ape again made according to the known manufacturing method by means of knife-shaped dies by which the V-shaped floors of the cross rib are obtained with an extremely reliable and symmetrical design of the fins on either side. The deformation of the contact part is then carried out, as a result of which, over the longitudinal distance, the short sides with the fins of the contact part merging into each other ape slightly curved, and in particular the fins ape curved more strongly inwards over approximately the first part of the longitudinal distance.

Figure 5:
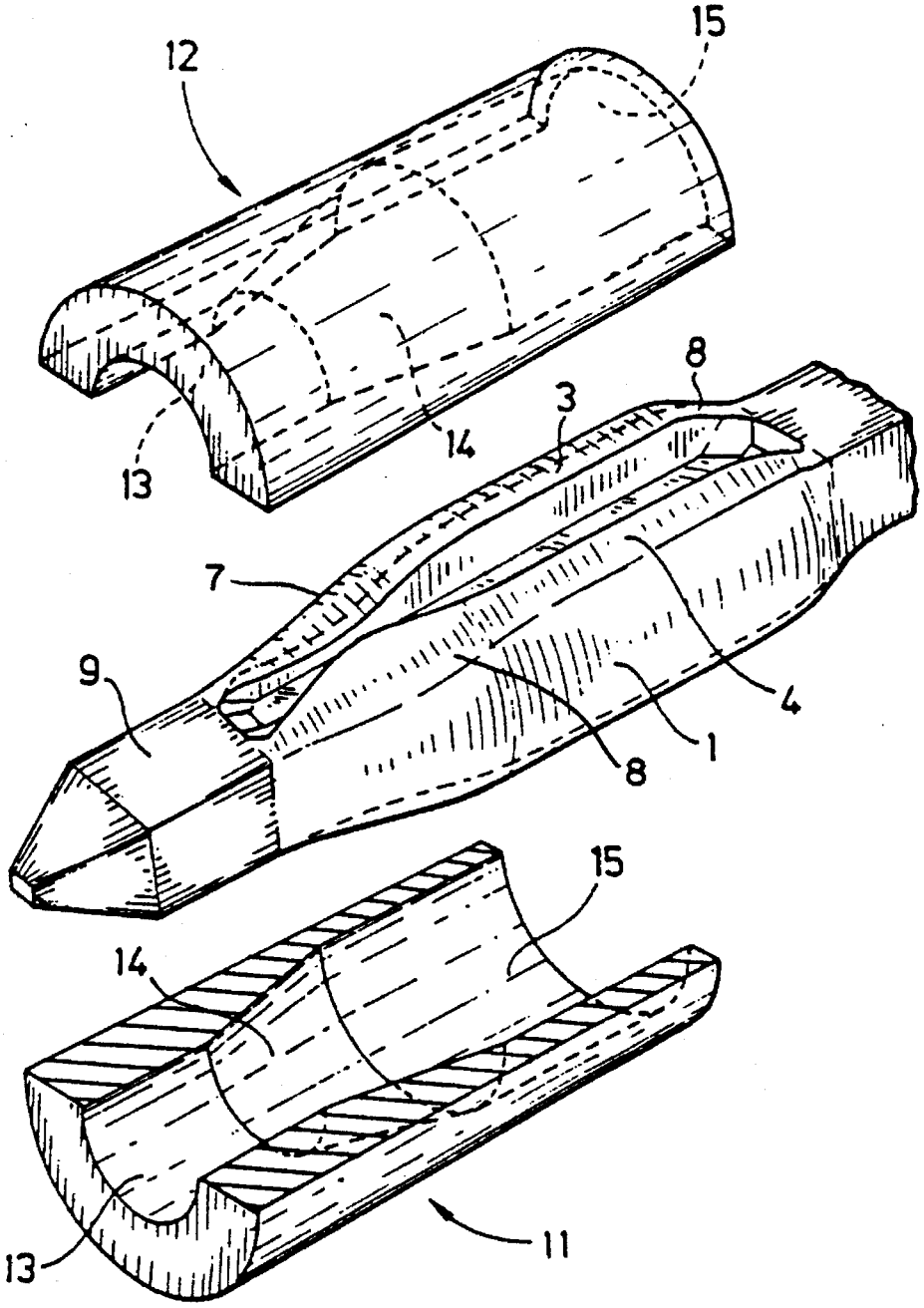
* and FIG. 5 gives a perspective view of the two press-on elements used for the deformation of the finished contact pin of FIG. 4*a* in the last step of manufacture.

FIG. 5 shows a perspective view of the finished and thus already deformed contact pin of FIG. 3*a*, with the two press-on elements or semi-circular bushes used for the deformation. The two bushes 11, 12 are shown in the retracted position symmetrically below and above the pin contact part respectively. The two bushes,in a first embodiment which is not shown each comprise a straight half cylinder. In another embodiment each semi-circular bush comprises a first semi-cylindrical part 13, a semi-conical part 14, and a second semi-cylindrical part 15. The two bushes are positioned against each other symmetrically in such a way relative to and around the contact pin to be deformed that the opposite lying transitions between the parts 13 and 14 lie in the transverse plane of the contact part, where the decreasing thickness of the cross rib 10 from the cross-sectional plane IIIc—IIIc in FIG. 3*b* becomes constant, and in such a way that the opposite-lying transitions between the parts 14 and 15 lie in the transverse plane of the contact part approximately half way along the longitudinal distance thereof. In an example of an embodiment, the diameter of the first cylindrical part is 0.62 mm, the angle of the conical part is 11°, and the diameter of the second cylindrical part is 0.85 mm.

The press-on movement of the two semi-circular bushes around and against the contact pins causes the four projecting fins to be curved inwards, as can be seen well at the top side of the pin in FIG. 3*a* and at one side of the pin in FIG. 4*a*. As can be seen in FIGS. 3*c*, 3*d* and 3*e*, the H-shape of the contact part now approaches a double C-shape. Through this deformation a better and more flexible insertion into the printed circuit board hole is obtained with a lower press-in force. This means that less deformation of the hole metallization is caused, and the position of the pin, i.e. no rotation, is retained, so that good contact with the counter plug is ensured.

We claim:

1. An electrical contact pin for insertion into a through hole in a printed circuit board, said through hole having inner walls, said electrical contact pin having a longitudinal axis, said electrical contact pin comprising:

an insertion portion for guiding said electrical contact pin into said through hole;

a cross rib integrally formed with said insertion portion, said cross rib defining longitudinal surfaces along said longitudinal axis;

fin-like contacts extending from said longitudinal surfaces towards distal ends, each of said fin-like contacts having a contact surface and a curved portion, wherein each of said curved portions extends a distance along the entire length as well as a substantial portion beginning from said longitudinal surfaces towards said distal ends of said fin-like contacts and is curved inwardly towards the center of said longitudinal surfaces; and a guiding portion comprised of a leading portion of each of said fin-like contacts, said guiding portion having a guiding surface which is curved to define a gradual curvature.

2. An electrical contact pin for insertion into a through hole in a printed circuit board, said through hole having circular inner walls, said electrical contact pin having a longitudinal axis, said electrical contact pin comprising:

an insertion portion for guiding said electrical contact pin into said through hole;

a cross rib integrally formed with said insertion portion, said cross rib defining longitudinal V-shaped surfaces along said longitudinal axis;

four fin-like contacts extending from said longitudinal surfaces towards distal ends, each of said fin-like contacts having a contact surface, two of said fin-like contact surfaces and said cross rib forming a cross section of a substantially letter C-shape, each of said fin-like contacts having a portion extending from said longitudinal surfaces towards said distal ends and curved inwardly toward the center of said V-shaped surfaces so as to conform to said circular walls of said through hole, wherein each of said inwardly curved portions extends a distance along the entire length of said fin-like contacts; and a guiding portion comprised of a leading portion of each of said fin-like contacts, said guiding portion having a guiding surface which is inwardly curved.

3. An electrical contact pin according to claim 2 wherein the inward curve of said guiding surface has a varying degree of curvature, wherein the degree of curvature first increases and then decreases along said longitudinal axis from said insertion portion to said contact surfaces.

* * * * *